US008354061B2

(12) United States Patent
Iwamoto

(10) Patent No.: US 8,354,061 B2
(45) Date of Patent: Jan. 15, 2013

(54) AIR PURIFICATION SYSTEM AND METHOD FOR CLEANING AIR

(75) Inventor: Takashi Iwamoto, Chiba (JP)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/552,325

(22) Filed: Jul. 18, 2012

(65) Prior Publication Data

US 2012/0279392 A1 Nov. 8, 2012

Related U.S. Application Data

(62) Division of application No. 13/143,715, filed as application No. PCT/JP2010/006437 on Nov. 1, 2010, now Pat. No. 8,252,238.

(51) Int. Cl.
*A62B 7/08* (2006.01)

(52) U.S. Cl. ..... 422/122; 422/121

(58) Field of Classification Search ..... 422/120–124
See application file for complete search history.

(56) References Cited

U.S. PATENT DOCUMENTS

| | | | |
|---|---|---|---|
| 3,607,262 | A | 9/1971 | Ueda et al. |
| 7,585,603 | B2 | 9/2009 | Yamada et al. |
| 2003/0039848 | A1 | 2/2003 | Murata et al. |
| 2003/0050196 | A1 | 3/2003 | Hirano et al. |
| 2006/0124442 | A1 | 6/2006 | Valpey, III et al. |
| 2007/0003850 | A1 | 1/2007 | Yamada et al. |
| 2012/0103191 | A1 | 5/2012 | Iwamoto |

FOREIGN PATENT DOCUMENTS

| | | | |
|---|---|---|---|
| CN | 1885175 | A | 12/2006 |
| JP | 05-165005 | | 6/1993 |
| JP | 06-002905 | | 1/1994 |
| JP | 7057414 | A | 3/1995 |
| JP | 2003062484 | A | 3/2003 |
| JP | 2007034256 | A | 2/2007 |
| JP | 2010142702 | | 7/2010 |

OTHER PUBLICATIONS

International Search Report and Written Opinion for PCT/JP2010/006437, dated Nov. 16, 2010.

Shimoda, et al., "Design Techniques of Organic Photoconductor for High-Speed Complex Machines" http://www.sharp.co.jp/corporate/rd/32/pdf/97_p22.pdf; (May 22-24, 2008) (English machine translation).

Shoda, et al., Carrier Generation in Layered Organic Photoconductors on Azo Pigment, *Surface Science* (2003), 24(1), 2-7.

"Claiming too much air purifier 'amadana PA-1001'", http://berick.blog116.fc2.com/blog-entry-165.html (English machine translation), May 25, 2009.

http://www.mcmcm.jp/business/b_ecoclean.html, MCM Co., Ltd. product page on dust collecting electrostric precipitator, [Printed from internet on Jun. 14, 2011] [English machine translation].

http://www.ya-man.com/shop/index.php/module/ShohinShosai/action/ShohinShosai/sno/1548/group/group1/catid/0-224/catno/224/1/224, Shopping Internet page on Ionicpro STA-98 Air Purifier Ionic Formula Ionikkupurotabo/household, [Printed from internet on Jun. 14, 2011] [English machine translation].

Hays, "How does a photocopier work?", Scientific American (www.scientificamerican.com/article.cfm?id=how-does-a-photocopier-wo Internet Article), Mar. 31, 2003.

*Primary Examiner* — Kevin Joyner
(74) *Attorney, Agent, or Firm* — Pepper Hamilton LLP

(57) ABSTRACT

Air purification systems comprising a plurality of disks, and methods for their use, are provided. Each of the plurality of disks comprises a metal substrate, an undercoat layer disposed on the metal substrate, a photosensitive layer disposed on the undercoat layer, and a charge transfer layer disposed on the photosensitive layer.

22 Claims, 3 Drawing Sheets

AIR PURIFICATION SYSTEM AND METHOD FOR CLEANING AIR

CLAIM OF PRIORITY

This application is a divisional of and claims priority to U.S. patent application Ser. No. 13/143,715, now U.S. Pat. No. 8,252,238, filed on Aug. 4, 2011, which is a national phase application under 35 U.S.C. §371 of International Application No. PCT/JP2010/006437, filed Nov. 1, 2010, each of which is incorporated herein by reference in its entirety.

TECHNICAL FIELD

Air cleaning technology, an air purification system, and a method for cleaning air are disclosed.

BACKGROUND

Air pollution in sealed spaces such as airplanes, automobiles and private rooms pose significant health risks. Pollutants typically include airborne particulates such as volatile organic compounds (VOCs) from construction materials, house dust and pollen, all of which are known to cause allergic reactions and a range of respiratory disorders.

In recent years, air purification systems featuring filtering systems designed to remove these pollutants have been developed. Global production of the air purification systems was about 12.29 million units in 2008 and is expected to rise to 12.34 million units in 2013. In response to the outbreak of new influenza viruses during 2009, manufacturers are developing expanded product ranges from cheaper entry-level products through to highly functional products. While North America and Europe account for a major share of global sales, demand for air cleaners is rising in China and other Asian markets due to the prevalence of influenza and other infectious diseases.

The conventional air purification systems use extremely fine grade filters to remove very fine particulates. However, the extremely fine grade filters are not only expensive but also tend to be clogged easily. Therefore, the conventional air purification systems require new filters every year. Accordingly, the operating costs of the conventional air purification systems are quite high.

SUMMARY

An aspect of the present disclosure relates to an air purification system comprising a plurality of disks. Each of the plurality of disks comprises a metal substrate, an undercoat layer disposed on the metal substrate, a photosensitive layer disposed on the undercoat layer, and a charge transfer layer disposed on the photosensitive layer.

Another aspect of the present disclosure relates to a method for cleaning air. The method comprises: rotating a plurality of disks, each of the plurality of disks comprising a metal substrate, an undercoat layer disposed on the metal substrate, a photosensitive layer disposed on the undercoat layer, and a charge transfer layer disposed on the photosensitive layer; irradiating the photosensitive layer with a light to induce an electric charge; and contacting air and the plurality of disks.

Yet another aspect of the present disclosure relates to a series of particulate absorption disks. Each of the particulate absorption disks comprises a metal substrate, an undercoat layer disposed on the metal substrate, a photosensitive layer disposed on the undercoat layer, and a charge transfer layer disposed on the photosensitive layer.

Yet another aspect of the present disclosure relates to a particulate absorption disk. The particulate absorption disk comprises a metal substrate, an undercoat layer disposed on the metal substrate, a photosensitive layer disposed on the undercoat layer, and a charge transfer layer disposed on the photosensitive layer.

DETAILED DESCRIPTION

Figure 1:
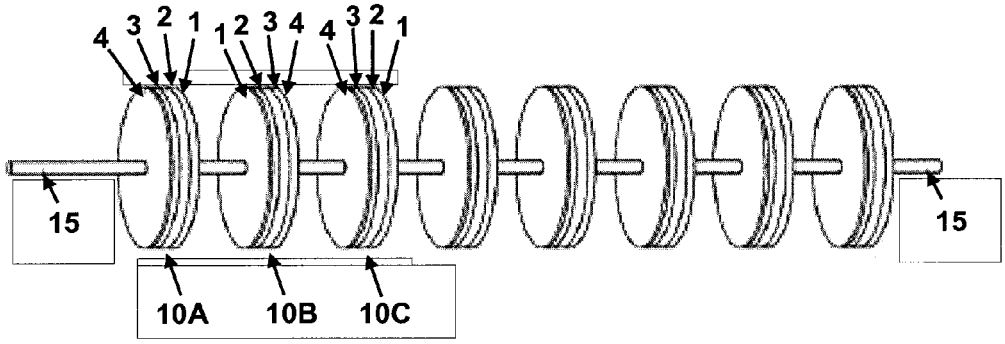
FIG. 1 shows a plurality of particulate adsorption disks.
Figure 2:
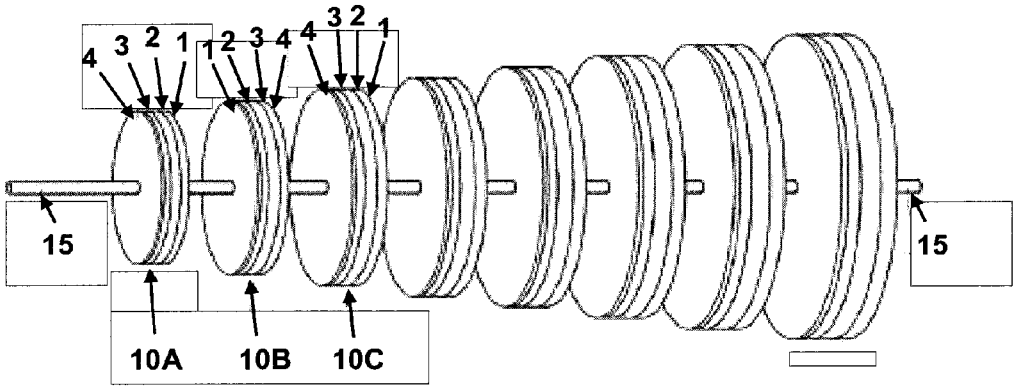
FIG. 2 shows a plurality of particulate adsorption disks mounted on a rotating shaft, where the diameter of the disks increases from one end of the shaft to the opposite end.
Figure 3:
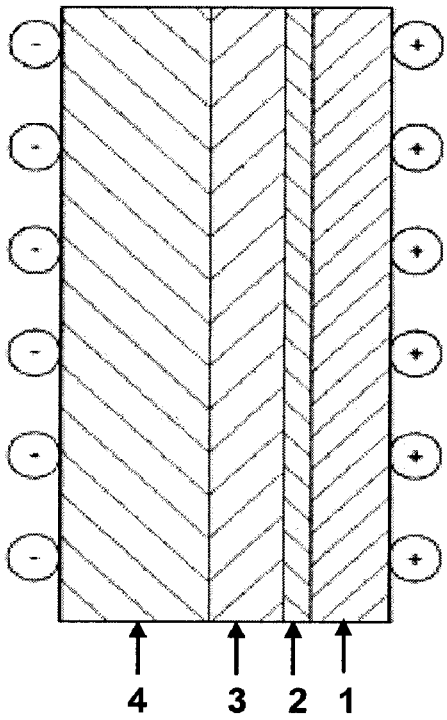
FIG. 3 shows a cross sectional view of the particulate adsorption disk.

With reference to FIG. 1, an air purification system can include a plurality of planar particulate adsorption disks 10A, 10B and 10C. The system can generally include any number of disks, such as 1, 2, 3, 4, 5, 6, 7, 8, 9, 10, 20, 30, 40, 50, 60, 70, 80, 90, 100, and so on. The number of discs may be selected to meet the desired capacity of the system. The discs may generally be any size and shape. The disks are typically flat and round in shape, but other shapes such as squares, triangles, pentagons, hexagons, and so on are equally possible. The individual disks are typically all the same shape and size, but the shape and size may vary. For example, one portion of the system may have smaller disks, while another portion of the system may have larger disks as shown in FIG. 2. Each of the plurality of particulate adsorption disks 10A, 10B and 10C comprises a metal substrate 1, an undercoat layer 2 disposed on the metal substrate 1, a photosensitive layer 3 disposed on the undercoat layer 2, and a charge transfer layer 4 disposed on the photosensitive layer 3, as shown in FIG. 3. A cross-section of the disk would first intersect the metal substrate, then the undercoat layer, then the photosensitive layer, then the charge transfer layer. The air purification system exhibits reduced or eliminated clogging relative to conventional air purification systems.

The metal substrate 1 can generally be made of any type of metal. Examples of suitable metals include aluminum, stainless steel, copper, iron, gold, and platinum. A thin resin coating may be deposited on the surface of metal substrate 1 to reduce or prevent corrosion of the surface opposite of undercoat layer 2. Alternatively, a plastic film or plastic sheet on which metal is attached via vapor deposition may be deposited on the surface of metal substrate 1.

The undercoat layer 2 is configured to reduce or prevent corrosion of the metal substrate 1. The undercoat layer 2 contains an insulating material or is an insulating material. In the case where the metal substrate 1 is composed of aluminum, an insulating aluminum oxide film can be made on the metal substrate 1 by oxidizing the metal substrate. Such insulating oxide film can be used as the undercoat layer 2. Alternatively, the surface of metal substrate 1 may be applied by various methods such as spin-coating or spraying with a polymer such as polyimide or polyimide to form the undercoat layer 2, for example.

The photosensitive layer 3 exhibits stable electrostatic properties and an electric charge is induced in the photosensitive layer 3 when the photosensitive layer 3 is exposed to light. The photosensitive layer 3 contains or is an organic photosensitive material or a photo semiconductor material, for example. The photosensitive layer 3 can be formed by various methods such as uniformly coating a solution of organic photo sensitive materials on the undercoat layer 2 with a spin coater or sprayer. The photo-sensitive material can be applied in a pure form, or with other materials such as binders or solvents. The solution of organic photosensitive material is prepared by mixing the photosensitive material such as azo compounds, phthalocyanines or hydrazones with a binder such as polyvinyl alcohol (PVA), vinyl acetate, polyvinyl butyral (PVB) or polycarbonate. The chemical formulas below show examples of the organic photo-sensitive materials. The ratio of binder to organic photosensitive material can generally be any ratio. Example ratios include about 0.1, about 0.5, about 1, about 5, and about 10 parts by weight of the binder to one part by weight of the organic photosensitive material.

[Chem. 2]

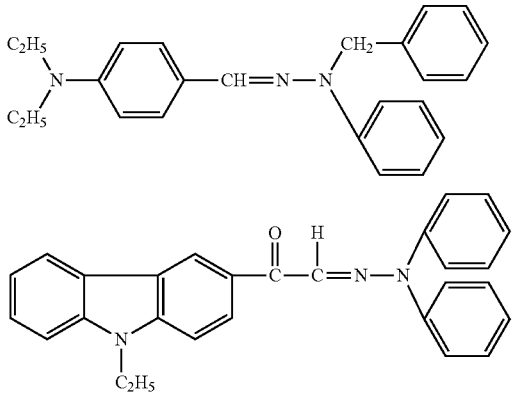

[Chem. 1]

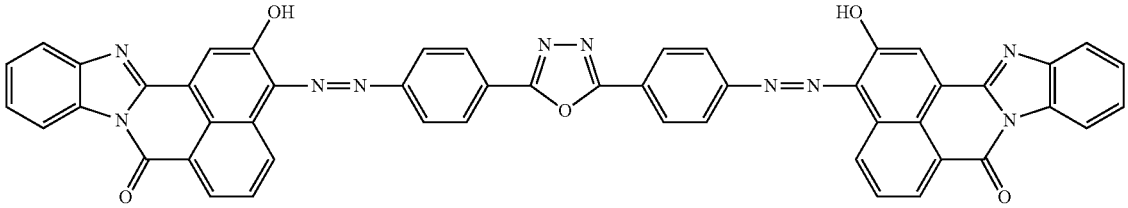

Azo CGM1

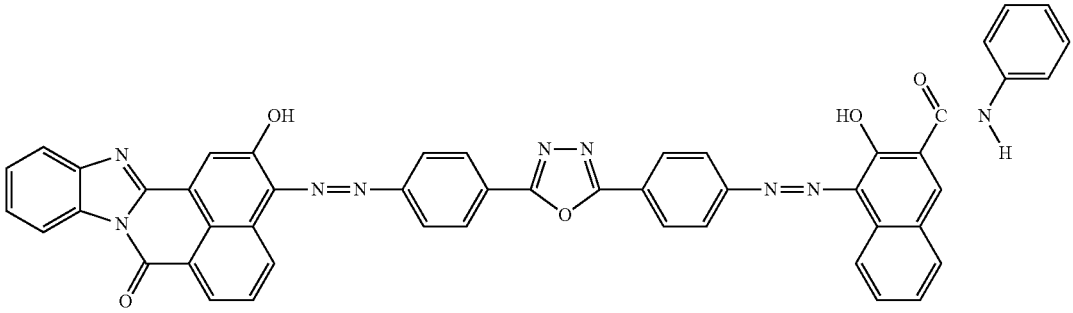

Azo CGM2

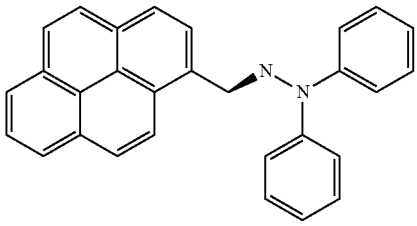

Hydrazone CTM1

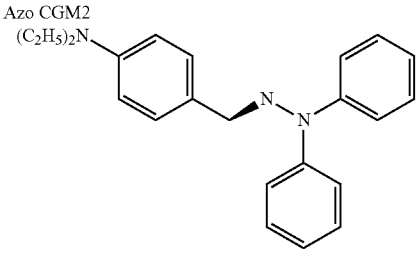

Hydrazone CTM2

The charge transfer layer 4 is configured to separate the negative charges from the positive charges. The negative charges are transferred to the surface of the charge transfer layer 4. The charge transfer layer 4 contains or is one or more of hydrazone compounds, pyrazoline compounds, polyvinyl ketone compounds, carbazole compounds, oxazole compounds, triazole compounds, aromatic amine compounds, amine compounds, triphenylmethane compounds, or polycyclic aromatic compounds. The chemical formulas below show examples of the materials for the charge transfer layer 4.

-continued

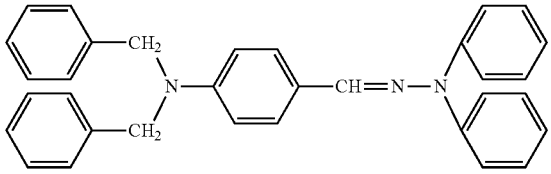

The materials described above can be mixed, melted, or dissolved with a resin binder. Generally any resin binder can be used. Example binder resins include silicone, styrene-butadiene copolymer, epoxy, acrylic, saturated or unsaturated polyester, poly-carbonate, polyvinyl acetal, phenolic resin, polymethylmethacrylate (PMMA), melamine, polyimide, polyvinyl chloride (PVC), and vinyl acetate. The mix ratio can generally be any ratio. Example ratios include about 0.1, about 0.5, about 1, about 5, and about 10 parts resin binder to one part charge transport material. The resulting mixture is coated over the photosensitive layer 3 with a spin coater or sprayer, for example.

With reference again to FIG. 1, the particulate adsorption disks 10A, 10B and 10C can be mounted by a rotating shaft 15 at various intervals depending on the thickness of each of the disks 10A, 10B and 10C and the air flow efficiency between the disks 10A, 10B and 10C. The distance between adjacent disks can generally be any distance, with examples being about 0.01 cm, about 0.02 cm, about 0.03 cm, about 0.04 cm, about 0.05 cm, about 0.1 cm, about 0.2 cm, about 0.3 cm, about 0.4 cm, about 0.5 cm, about 1 cm, about 2 cm, and ranges between any two of these values. The distance between adjacent disks typically will be the same distance between any two adjacent disks, but can alternatively vary. The rotating shaft 15 penetrates through each of the centers of the circular disks 10A, 10B and 10C. The rotating shaft will typically be axially perpendicular to the surface of the disks, but can be oriented at any angle. The rotating shaft 15 can be connected to a motor to rotate the particulate adsorption disks 10A, 10B and 10C.

Figure 4:
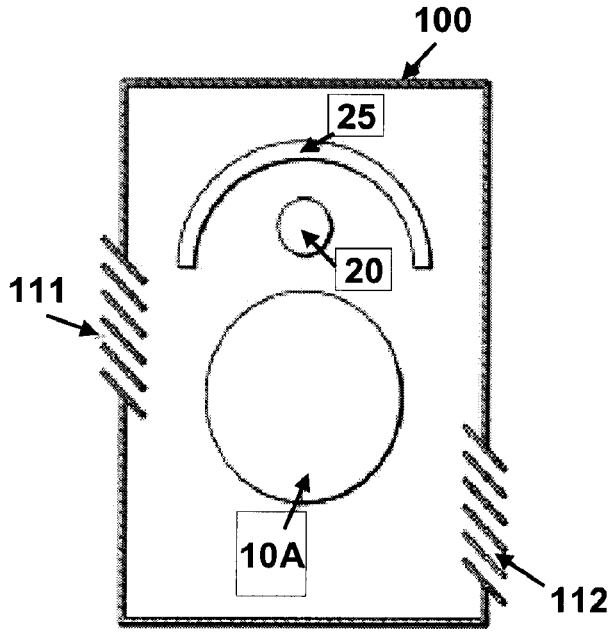
FIG. 4 shows a diagram of an air purification system.

With reference next to FIG. 4, the air purification system can further comprise a light source 20 configured to induce the electric charge in each photosensitive layer 3 of the particulate adsorption disks 10A, 10B and 10C shown in FIGS. 1-3. The light source 20 can be disposed at any angle, but typically is disposed parallel to the rotating shaft 15. Fluorescent lights, halogen lamps, xenon lamps, Light Emitting Diode (LED), and lasers, for example, can be used as the light source 20. The LED and the lasers are readily available, inexpensive, and long-lasting. A reflector 25 may be disposed near the light source 20 to reflect a light emitted from the light source 20 to the photo-sensitive layer 3.

The electric charge induced by the light emitted from the light source 20 moves through the charge transfer layer 4 and emerges from the surface of the charge transfer layer 4 as a negative charge, while a positive charge emerges from the surface of the opposing metal substrate 1. As described above, the rotating shaft 15 mounting the particulate adsorption disks 10A, 10B and 10C is connected to the motor. When the particulate adsorption disks 10A, 10B and 10C are rotated by the motor, an air current moves in the direction of rotation of the particulate adsorption disks 10A, 10B and 10C. This rotation draws the air to be purified through the gaps between the particulate adsorption disks 10A, 10B and 10C.

The positively charged particulates in the air are drawn to the surface of the charge transfer layer 4 that is negatively charged. Therefore, the positively charged particulates adsorb onto the surface of the charge transfer layer 4 by the electrostatic attractive force. The negatively charged particulates in the air are drawn to the surface of the metal substrate 1 that is positively charged. Therefore, the negatively charged particulates adsorb onto the surface of the metal substrate 1 by the electrostatic attractive force.

The disks can be rotated at generally any speed. For example, the particulate adsorption disks 10A, 10B and 10C can be rotated at a rate of about 30 rpm and about 300 rpm. Lower speeds may reduce airflow and lower the rate of air purification. Very high speeds may generate Coriolis forces at the disk surface, also reducing air purification. Various speeds may be desirable depending on the size and shape of the disks, number of disks, degree of air cleaning needed, and so on.

At least one protrusion may be provided on each of the metal substrates 1. Each protrusion on the metal substrates 1 induces air flow during the rotation of particulate adsorption disks 10A, 10B and 10C. Induced air flow may reduce or eliminate the use of an external fan in the system, reducing noise and energy usage.

As shown in FIG. 4, the particulate adsorption disks 10A, 10B and 10C, the light source 20, and the reflector 25 may be contained in a housing 100. The housing 100 has an air intake 111 and an air outlet 112. A coarse filter configured to remove the large particulates may be attached to the air intake 111. The air to be purified is drawn into the inside of the housing from the air intake 111 and is purified by the rotating particulate adsorption disks 10A, 10B and 10C. The purified air flows from the air outlet 112 of the housing 100.

Individual disks may be arranged in various ways relative to each other, either randomly or in an ordered manner. In one example, each disk is disposed in the same orientation within the system. In this orientation, the top of one disk is adjacent to the bottom of the next disk. In alternative example, each disk is disposed in the opposite and alternating orientation to the next disk. In this orientation, the top of one disk is adjacent to the top of the next disk. With reference again to FIG. 1, the particulate adsorption disks 10A, 10B and 10C are arranged so that the charge transfer layers 4 are opposed to each other and the metal substrates 1 are opposed to each other. By this arrangement, surfaces having the same polarity are opposed to each other. This arrangement reduces or eliminates equipotential points from generating between the particulate adsorption disks 10A, 10B and 10C. Therefore, this arrangement effectively reduces the probability of particulates passing through the particulate adsorption disks 10A, 10B and 10C without adhering to the particulate adsorption disks 10A, 10B and 10C.

Since the particulate adsorption disks 10A, 10B and 10C are charged to different polarities on each side, both positively and negatively charged particulates are attracted to the particulate adsorption disks 10A, 10B and 10C simultaneously. The conventional ion air cleaners generate a particulate ion current by using high-voltage electrodes. The conventional electrostatic precipitators positively charge the particulates in an electrode grid then trapped the particulates in a negatively charged electrode filter. Mechanisms of these conventional air purification systems are complex. On the contrary, the air purification system described herein efficiently uses both positive and negative electrodes. Therefore, the mechanism of the air purification system described herein could be less complex than the conventional air purification systems. Depending on the size of particles in the air, the coarse filter attached to the air intake 111 shown in FIG. 4 may be eliminated. Therefore, the air purification system makes it possible to remove the nano particulates without the clogging of filters.

Figure 5:
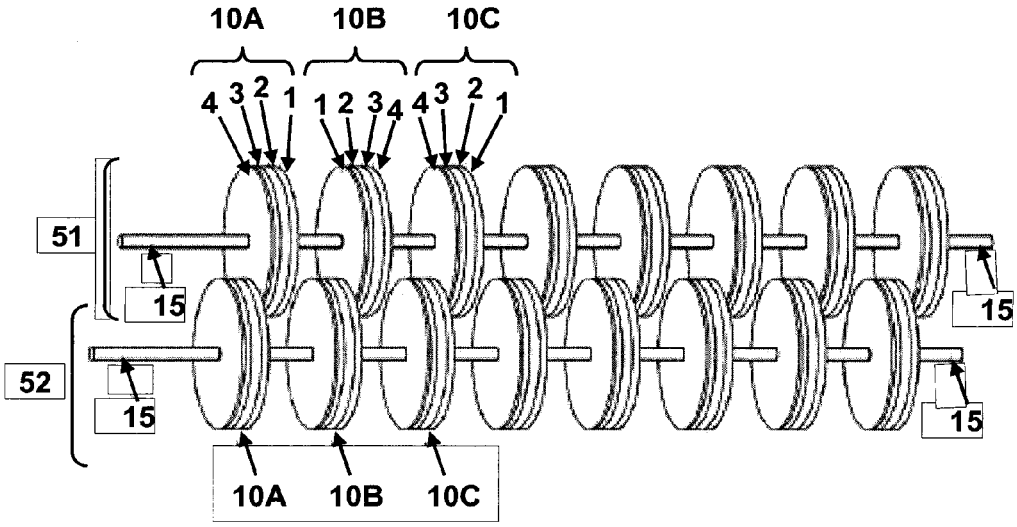
FIG. 5 shows the plurality of particulate adsorption disks.

With reference to FIG. 5, the particulate adsorption disks 10A, 10B and 10C may be arranged as an array. A first column 51 including the particulate adsorption disks 10A, 10B and 10C are disposed parallel to a second column 52 including the particulate adsorption disks 10A, 10B and 10C. Two, three, four, five, six, seven, eight, nine, ten, or more columns may be disposed.

The particulate adsorption disks 10A, 10B and 10C of the second column 52 can be inserted in the gaps between the particulate adsorption disks 10A, 10B and 10C of the first column 51. The metal substrates 1 of the particulate adsorption disks WA, 10B and 10C of the first column 51 may be opposed to the charge transfer layers 4 of the particulate adsorption disks 10A, 10B and 10C of the second column 52. Also, the charge transfer layers 4 of the particulate adsorption disks 10A, 10B and 10C of the first column 51 may be opposed to the metal substrates 1 of the particulate adsorption disks 10A, 10B and 10C of the second column 52.

The particulates that do not adsorb onto the metal substrates 1 of the first column 51 are attracted by the charge transfer layers 4 of the second column 52. The particulates that do not adsorb onto the charge transfer layers 4 of the first column 51 are attracted by the metal substrates 1 of the second column 52.

Figure 6:
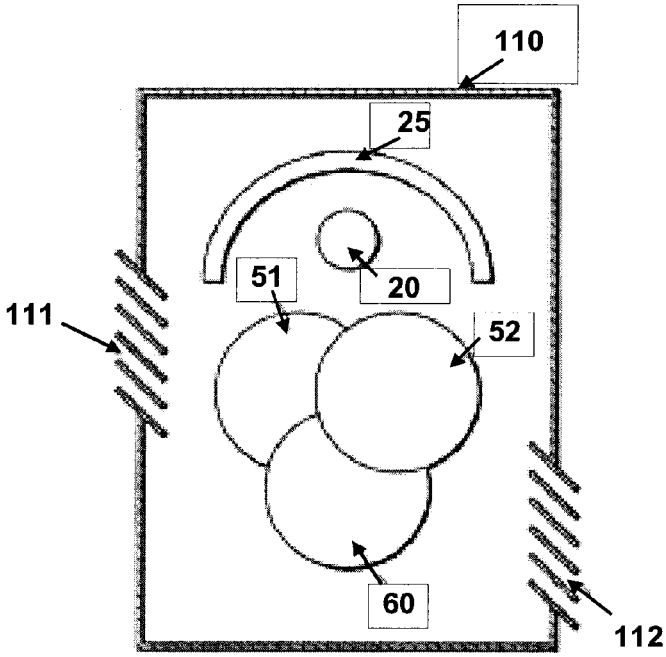
FIG. 6 shows a diagram of the air purification system.
Figure 1:
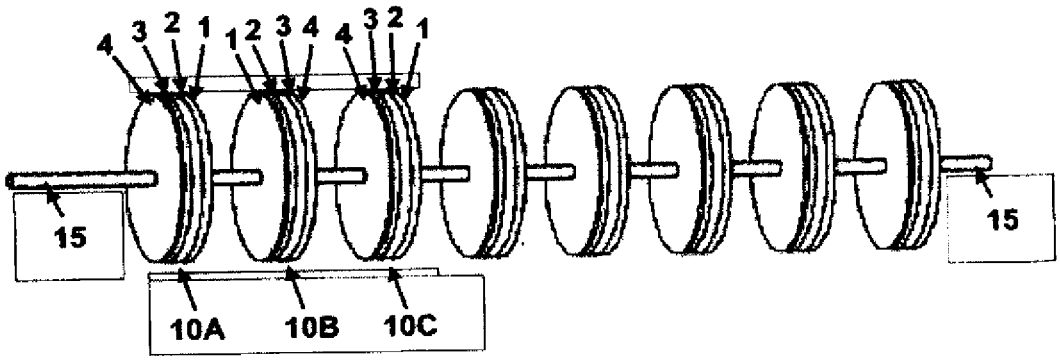
Figure 2:
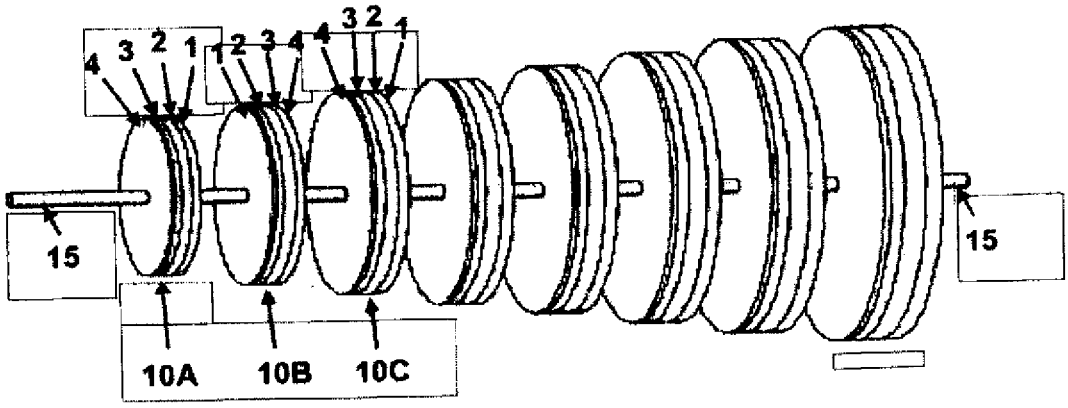

With reference to FIG. 6, the air purification system can further include a wiper 60 configured to wipe the surface of the metal substrate 1 or the surface of the charge transfer layer 4. The wiper can generally be made of any material and can be of any shape. For example, a circular polyethylene non-woven fabric pad can be used for the wiper 60. The wiper 60 may be connected to a shaft and a motor for rotating the wiper 60. While the light source 20 emits the light and the particulate adsorption disks 10A, 10B and 10C attract the particulates, the wiper 60 can be separate from the particulate adsorption disks 10A, 10B and 10C. When the light source 20 is turned off, the wiper 60 can be moved to one or all of the particulate adsorption disks 10A, 10B and 10C and wipes off the particulates adsorbing the surfaces of the particulate adsorption disks 10A, 10B and 10C. The air purification system may further include a plurality of wipers for wiping the particulate adsorption disks 10A, 10B and 10C respectively. The plurality of wipers may be mounted by the shaft connected to the motor.

Modifications and variations of the embodiments described above will occur to those skilled in the art, in the light of the above teachings. For example, the air purification system described herein may further include an electrode configured to charge the particulate. The electrode may be disposed near the air intake 111 of the housing 100 shown in FIG. 4. The particulates charged by the electrode are effectively attracted by the particulate adsorption disks 10A, 10B and 10C. The scope of this disclosure is defined with reference to the following claims.

The invention claimed is:

1. A method for cleaning air comprising:

rotating a plurality of disks, each of the plurality of disks comprising a metal substrate, an undercoat layer disposed on the metal substrate, a photosensitive layer disposed on the undercoat layer, and a charge transfer layer disposed on the photosensitive layer;

irradiating the photosensitive layer with a light to induce an electric charge; and contacting air and the plurality of disks.

2. The method of claim 1, wherein the plurality of disks are arranged so that the charge transfer layers of adjacent disks are opposed to each other.

3. The method of claim 1, wherein the plurality of disks are arranged to that the metal substrates of adjacent disks are opposed to each other.

4. The method of claim 1, wherein the plurality of disks are arranged as an array.

5. The method of claim 1, wherein the plurality of disks are mounted by a rotating shaft.

6. The method of claim 5, wherein the plurality of disks are rotated by a motor connected to the rotating shaft.

7. The method of claim 1, wherein a protrusion is provided on the metal substrate.

8. The method of claim 1, further comprising wiping a surface of the metal substrate.

9. The method of claim 1, further comprising wiping a surface of the charge transfer layer.

10. The method of claim 1, wherein the metal substrate comprises aluminum, stainless steel, copper, iron, gold or platinum.

11. The method of claim 1, wherein rotating the plurality of disks comprises rotating the plurality of disks at a rate of about 30 revolutions per minute (rpm) to about 300 rpm.

12. A method for cleaning air comprising:

rotating a plurality of first disks and a plurality of second disks, wherein each of the first disks and the second disks comprises a metal substrate, an undercoat layer disposed on the metal substrate, a photosensitive layer disposed on the undercoat layer, and a charge transfer layer disposed on the photosensitive layer, wherein the plurality of first disks are mounted by a first rotating shaft, wherein the plurality of second disks are mounted by a second rotating shaft, wherein each second disk is positioned in a gap between adjacent first disks;

irradiating each photosensitive layer with a light to induce an electric charge; and contacting air and the plurality of disks.

13. The method of claim 12, wherein, for each first disk, the metal substrate of the first disk is opposed to a charge transfer layer of a second disk.

14. The method of claim 12, wherein, for each first disk, the charge transfer layer of the first disk is opposed to a charge transfer layer of a second disk.

15. The method of claim 12, wherein, for each first disk, the metal substrate of the first disk is opposed to a metal substrate of a second disk.

16. The method of claim 12, wherein the plurality of first disks are rotated by a first motor connected to the first rotating shaft and the plurality of second disks are rotated by a second motor connected to the second rotating shaft.

17. The method of claim 12, wherein the plurality of first disks and the plurality of second disks are rotated by a motor connected to each of the first rotating shaft and the second rotating shaft.

18. The method of claim 12, wherein a protrusion is provided on the metal substrate of at least one first disk, at least one second disk or a combination thereof.

19. The method of claim 12, further comprising wiping a surface of the metal substrate of at least one first disk, at least one second disk or a combination thereof.

20. The method of claim 12, further comprising wiping a surface of the charge transfer layer of at least one first disk, at least one second disk or a combination thereof.

21. The method of claim 12, wherein each metal substrate comprises aluminum, stainless steel, copper, iron, gold or platinum.

22. The method of claim 12, wherein rotating the plurality of first disks and the plurality of second disks comprises rotating the plurality of first disks and the plurality of second disks at a rate of about 30 revolutions per minute (rpm) to about 300 rpm.

* * * * *

UNITED STATES PATENT AND TRADEMARK OFFICE

CERTIFICATE OF CORRECTION

PATENT NO. : 8,354,061 B2
APPLICATION NO. : 13/552325
DATED : January 15, 2013
INVENTOR(S) : Iwamoto It is certified that error appears in the above-identified patent and that said Letters Patent is hereby corrected as shown below:

The title page showing the illustrative figure should be deleted to be replaced with the attached title page.

In the drawing sheets, consisting of Fig. 1, should be deleted to be replaced with the drawing sheet, consisting of Fig. 1, as shown on the attached pages.

In the Specification:

In Column 2, Line 64, delete "as polyimide" and insert -- as polyamide --, therefor.

In Column 6, Line 67, delete "WA," and insert -- 10A, --, therefor.

In Column 7, Line 26, delete "adsorbing" and insert -- adsorbing onto --, therefor.

In the Claims:

In Column 7, Line 56, in Claim 3, delete "to that" and insert -- so that --, therefor.

Signed and Sealed this
Twenty-ninth Day of October, 2013

Teresa Stanek Rea
*Deputy Director of the United States Patent and Trademark Office*

(12) United States Patent
Iwamoto

(10) Patent No.: US 8,354,061 B2
(45) Date of Patent: Jan. 15, 2013

(54) AIR PURIFICATION SYSTEM AND METHOD FOR CLEANING AIR

(75) Inventor: Takashi Iwamoto, Chiba (JP)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/552,325

(22) Filed: Jul. 18, 2012

(65) Prior Publication Data

US 2012/0279392 A1 Nov. 8, 2012

Related U.S. Application Data

(62) Division of application No. 13/143,715, filed as application No. PCT/JP2010/006437 on Nov. 1, 2010, now Pat. No. 8,252,238.

(51) Int. Cl.
*A62B 7/08* (2006.01)

(52) U.S. Cl. ..... 422/122; 422/121

(58) Field of Classification Search ..... 422/120–124
See application file for complete search history.

(56) References Cited

U.S. PATENT DOCUMENTS

| | | | |
|---|---|---|---|
| 3,607,262 | A | 9/1971 | Ueda et al. |
| 7,585,603 | B2 | 9/2009 | Yamada et al. |
| 2003/0039848 | A1 | 2/2003 | Murata et al. |
| 2003/0050196 | A1 | 3/2003 | Hirano et al. |
| 2006/0124442 | A1 | 6/2006 | Valpey, III et al. |
| 2007/0003850 | A1 | 1/2007 | Yamada et al. |
| 2012/0103191 | A1 | 5/2012 | Iwamoto |

FOREIGN PATENT DOCUMENTS

| | | | |
|---|---|---|---|
| CN | 1885175 | A | 12/2006 |
| JP | 05-165005 | | 6/1993 |
| JP | 06-002905 | | 1/1994 |
| JP | 7057414 | A | 3/1995 |
| JP | 2003062484 | A | 3/2003 |
| JP | 2007034256 | A | 2/2007 |
| JP | 2010142702 | | 7/2010 |

OTHER PUBLICATIONS

International Search Report and Written Opinion for PCT/JP2010/006437, dated Nov. 16, 2010.

Shumoda, et al., "Design Techniques of Organic Photoconductor for High-Speed Complex Machines" http://www.sharp.co.jp/corporate/rd/32/pdf/97_p22.pdf; (May 22-24, 2008) (English machine translation).

Shoda, et al., Carrier Generation in Layered Organic Photoconductors on Azo Pigment, *Surface Science* (2003), 24(1), 2-7.

"Claiming too much air purifier 'amadana PA-1001'", http://berick blog116.fc2.com/blog-entry-165.html (English machine translation), May 25, 2009.

http://www.mcmcm.jp/business/b_ecoclean.html, MCM Co., Ltd. product page on dust collecting electrostric precipitator, [Printed from internet on Jun. 14, 2011] [English machine translation]

http://www.ya-man.com/shop/index.php/module/ShohinShosai/action/ShohinShosai/sno/1548/group/group1/catid/0-224/catno/224/1/224, Shopping Internet page on Ionicpro STA-98 Air Purifier Ionic Formula Ionikkupurotabo/household, [Printed from internet on Jun 14, 2011] [English machine translation].

Hays, "How does a photocopier work?", Scientific American (www.scientificamerican.com/article.cfm?id=how-does-a-photocopier-wo Internet Article), Mar. 31, 2003.

*Primary Examiner* — Kevin Joyner
(74) *Attorney, Agent, or Firm* — Pepper Hamilton LLP

(57) ABSTRACT

Air purification systems comprising a plurality of disks, and methods for their use, are provided. Each of the plurality of disks comprises a metal substrate, an undercoat layer disposed on the metal substrate, a photosensitive layer disposed on the undercoat layer, and a charge transfer layer disposed on the photosensitive layer.

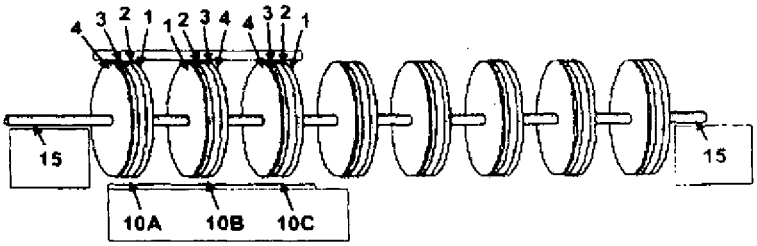

22 Claims, 3 Drawing Sheets